US006468655B1

(12) United States Patent
Kato et al.

(10) Patent No.: US 6,468,655 B1
(45) Date of Patent: Oct. 22, 2002

(54) SMOOTH POLYESTER FIBER

(75) Inventors: Jinichiro Kato; Katsuhiro Fujimoto, both of Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/601,194

(22) PCT Filed: Jan. 28, 1999

(86) PCT No.: PCT/JP00/00366

§ 371 (c)(1),
(2), (4) Date: Jul. 28, 2000

(87) PCT Pub. No.: WO99/39041

PCT Pub. Date: Aug. 5, 1999

(30) Foreign Application Priority Data

Jan. 29, 1998 (JP) ..... 10-030391

(51) Int. Cl.[7] ..... D02G 3/00

(52) U.S. Cl. ..... 428/395; 428/364; 428/375; 428/394

(58) Field of Search ..... 428/375, 394, 428/395, 364

(56) References Cited

U.S. PATENT DOCUMENTS

| | | | | |
|---|---|---|---|---|
| 4,394,126 A | | 7/1983 | Wilson | |
| 4,561,987 A | | 12/1985 | Yamamoto et al. | 252/8.9 |
| 6,284,370 B1 | * | 9/2001 | Fujimoto et al. | 428/364 |
| 2001/0003618 A1 | * | 6/2001 | Kato et al. | 428/395 |

FOREIGN PATENT DOCUMENTS

| | | | |
|---|---|---|---|
| EP | 0 547 846 | | 6/1993 |
| JP | 58-104216 | | 6/1983 |
| JP | 63-57548 | | 11/1988 |
| JP | 2-229272 | | 9/1990 |
| JP | 04024284 | | 1/1992 |
| JP | 04194077 | | 7/1992 |
| JP | 7-173768 | | 7/1995 |
| JP | 09262046 | | 10/1997 |
| WO | WO00/22210 | * | 4/2000 |

* cited by examiner

*Primary Examiner*—Cynthia H. Kelly
*Assistant Examiner*—J. M. Gray
(74) *Attorney, Agent, or Firm*—Finnegan, Henderson, Farabow, Garrett & Dunner, L.L.P.

(57) ABSTRACT

The present invention discloses a polyester fiber having a birefringence of 0.025 or more, comprising at least 90% by weight of a poly (trimethylene terephthalate), on which a finishing agent composed essentially of (1) an aliphatic hydrocarbon ester having a molecular weight of 300 to 800 and/or a mineral oil having a Redwood viscosity at 30° C. of 40 to 500 seconds, (2) a polyether having a structure containing an ethylene oxide unit and a propylene oxide unit, (3) a nonionic surfactant, and (4) an ionic surfactant in a specific proportion is applied.

11 Claims, No Drawings

SMOOTH POLYESTER FIBER

TECHNICAL FIELD

The present invention relates to a poly (trimethylene terephthalate) fiber, suited for use in clothing, which has excellent smoothness, abrasion resistance, cohesiveness and has an anti-static electricity property. The fiber also has good processability during various steps from the spinning step to the post-processing step, for example, during the spinning and drawing steps, unwinding step from yarn package, false-twist texturing, weaving, and knitting processings, and extremely good wound form of yarn package, thus providing a knitted/woven fabric having good quality such as elastic recovery, soft hand and homogeneity.

BACKGROUND ART

Poly(trimethylene terephthalate) (hereinafter abbreviated to "PTT") obtained by polycondensing terephthalic acid or a lower alcohol ester of terephthalic acid represented by dimethyl terephthalate with trimethylene glycol (1,3-propanediol) is an epochal polymer having both properties which resemble those of polyamide, for example, excellent elastic recoverly, low elastic modulus (soft hand) and ease of dyeing, and properties which resemble to those of poly (ethylene terephthalate) (hereinafter abbreviated to "PET"), for example, light resistance, thermosetting property, dimensional stability and low water absorption. PTT has been applied to products such as clothing, BCF carpet, brushes and tennis gut due to the above-described features (Unexamined Patent Publication (Kokai) Nos. 9-3724, 8-173244 and 5-262862).

One of fibrous forms capable of employing the above-described properties of the PTT fiber as much as possible includes a false-twist textured yarn. The false-twist textured yarn of the. PTT fiber can serve as a markedly excellent raw yarn for stretch material because it is superior in elastic modulus and softness to known synthetic fibers, for example, polyester fiber such as PET fiber (Unexamined Patent Publication (Kokai) No. 9-78373).

On spinning and false-twist texturing of the polyester fiber represented by the PET fiber, it is essential to apply a finishing agent to the surface of the fiber. If the spinning and false-twist texturing are conducted without applying the finishing agent on the surface of the fiber, friction and static electricity increase to cause nap and yarn cutting, thus making it impossible to conduct industrial production. In the case where the false-twist texturing of the PET fiber is conducted, a finishing agent containing 70% by weight or more of a polyether prepared by copolymerizing polyoxyethylene with polyoxypropylene (hereinafter referred to as "polyether") is usually applied to the surface of the fiber (e.g. Unexamined Patent Publication (Kokai) No. 63-57548). The reason is as follows. That is, since heating at 200° C. or higher is required in the thermosetting step in the false-twist texturing of the PET fiber, it becomes necessary to use a finishing agent comprising a polyether, which is superior in heat resistance, as a principal component in order to inhibit staining of the heater caused by heat deterioration, although the friction coefficient increases.

With respect to a finishing agent for false twisting of the PTT fiber, an optimum composition has never been suggested, heretofore. The reason is as follows. That is, there has not been a method of preparing trimethylene glycol as a raw material of PTT until recently and an industrial study of production of the PTT fiber has never been made.

Considering the finishing agent for false twisting of the PET fiber, it may be supposed that the finishing agent for false twisting of the PET fiber can be used for the PTT fiber as it is because the PTT fiber and PET fiber resemble each other in chemical structure. As is apparent from the present inventors' study, a finishing agent suited for the PTT fiber must be designed for the following two reasons. That is, (1) the PTT fiber and the polyester fiber other than the PTT fiber, which is represented by the PET fiber, differ drastically in physical properties of the fiber, in particular, the PTT fiber has a large friction coefficient and abrasive resistance, and (2) they differ drastically in optimum temperature conditions of the thermosetting step in the false-twist texturing step so that the thermosetting temperature of the PTT fiber must be set to a low temperature.

First, it will be shown that the PTT fiber has a large friction coefficient and abrasive resistance.

The PTT fiber exhibits such properties that the PTT fiber contracts easily to an original length when stretched like an elastic yarn because molecules of the PTT fiber bend largely in a Z-shape. Due to such elastic properties, when a single yarn is contacted with a roll, guide, hot plate or pin, or single yarns are contacted with each other in a state where a tension is applied in the spinning and processing step, the contact area increases, thereby to enhance the friction coefficient. When the spinning and drawing are continued in such a state, a nap is liable to occur. It has also been found that a nap of the fiber is liable to occur when the PTT fibers are rubbed with each other or the PTT fiber is strongly rubbed with the material other than the PTT fiber at the fiber side. It is assumed that such an ease of abrading depends on a Z-shaped bent molecular structure and that such a Z-shaped structure leads to reduction in an intermolecular force between adjacent molecules thereby to reduce a cohesive force acted in the intermolecular direction, thus deteriorating abrasion properties. On the other hand, the other polyester fiber, for example, PET fiber and poly (butylene terephthalate) fiber hardly exhibit elastic properties because its molecular chain is in the state of being extended to full length. The intermolecular cohesive force also tends to increase. Therefore, problems concerning friction properties and abrasion resistance of the PTT fiber hardly occur. If the finishing agent for false twisting of the PET fiber is applied to the PTT fiber, a polyether as a principal component of the finishing agent has a small effect of reducing the friction coefficient thereby to cause nap and yarn cutting. Therefore, the finishing agent for false twisting of the PET fiber can not be used industrially.

Next, it will be shown that the optimum temperature of the thermosetting step in the false-twist texturing step must be set to a lower temperature than that of the PET fiber.

As described previously, the thermosetting temperature in the false-twist texturing of the PET fiber exceeds 200° C., but the PTT fiber cannot be thermally set at a temperature of 190° C. or higher according to the present inventors' study. The reason is as follows. That is, when the PTT fiber is heated to a temperature of 190° C. or higher, the tenacity and elongation are drastically lowered and cutting of the fiber is liable to Accordingly, the thermosetting temperature of the PTT fiber in the false-twist texturing is usually within a range from 140 to 190° C. Since the glass transition point of the PTT fiber is lower than that of the PET fiber even at a low thermosetting temperature, it becomes possible to conduct sufficient thermosetting. Accordingly, it is not necessary to secure the heat resistance at 200° C. or higher in the finishing agent for false twisting of the PTT fiber so that it is not required to expressly use a finishing agent comprising a polyether component as a principal component, which has a poor effect of lowering the friction coefficient of the surface of the fiber.

As described above, a study on a finishing agent for false twisting and weaving/knitting, which is suited for the PTT fiber, has hardly been made. At present, a suggestion with respect to the necessity of design of a finishing agent in consideration of specific frictional abrasion properties of the PTT fiber and conditions of false twisting, and a means for solving the problem, have not been made.

Accordingly, the design of a finishing agent having a performance capable of solving problems due to the above-described specific properties of the fiber is indispensable to the industrial production of the PTT fiber.

Unexamined Patent Publication (Kokai) Nos. 4-24284 and 4-194077 suggest a finishing agent for PET, comprising a liquid aromatic hydrocarbon ester. However, even if this finishing agent is applied to the PTT fiber, the dynamic friction coefficient is not reduced and the occurrence of nap can not be inhibited.

With respect to the finishing agent of the PTT fiber, there is disclosed a technique of applying a surface treatment finishing agent comprising a silicone component or a Teflon component to a fishing line made of PTT (Unexamined Patent Publication (Kokai) No. 9-262046), though a fiber for clothing is not the subject of the finishing agent. However, there are drawbacks, that is, when using the finishing agent comprising a silicone component or a Teflon component as a principal component to the PTT fiber for clothing, it becomes difficult to remove the finishing agent during the scouring step of the fiber and the anti-static electricity property is lowered. Accordingly, only a product having poor feeling such as sliminess can be obtained from a cloth of the fiber using such a finishing agent.

As described above, no known technique suggests the design of the finishing agent, which is indispensable to solving of specific problems such as friction and abrasion in spinning and processing of the PTT fiber, particularly PTT fiber for use in clothing.

An object of the present invention is to provide a PTT fiber having excellent smoothness, abrasion resistance, cohesiveness and anti-static electricity property on which a finishing agent capable of solving problems of processability during the spinning and processing steps, that are caused by specific high abrasion coefficient and ease of abrading of the side of the fiber, is applied.

A more specific object of the present invention is to provide a PTT fiber on which an improved finishing agent is applied, which is capable of preparing a knitted/woven fabric having good quality such as elastic recovery, soft hand and homogeneity by enhancing processability during various steps from the spinning step to the post-processing step, for example, processability during the spinning and drawing steps, unwinding step from yarn package, false-twist texturing, weaving, and knitting processings.

DISCLOSURE OF THE INVENTION

An object of the present invention is attained by a polyester fiber having a birefringence of 0.025 or more, comprising at least 90% by weight of a poly (trimethylene terephthalate), on which a finishing agent comprising (1) an aliphatic hydrocarbon ester having a molecular weight of 300 to 800 and/or a mineral oil having a Redwood viscosity at 30° C. of 40 to 500 seconds, (2) a polyether having a specific structure, (3) a nonionic surfactant, and (4) an ionic surfactant in a specific proportion is applied in a specific amount.

That is, the present invention is directed to a polyester fiber having a birefringence of 0.025 or more, comprising at least 90% by weight of a poly (trimethylene terephthalate), a finishing agent being applied on the surface of said fiber in the amount of 0.2 to 3% by weight, said finishing agent comprising, as an essential component, compounds (1) to (4):

(1) an aliphatic hydrocarbon ester having a molecular weight of 300 to 800 and/or a mineral oil having a Redwood viscosity at 30° C. of 40 to 500 seconds, the content of which is 30 to 80% by weight based on the total amount of said finishing agent, (2) a polyether having a structure represented by the following structural formula:

$$R_1—O—(CH_2CH_2O)n_1—(CH(CH_3)CH_2O)n_2—R_2$$

(wherein $R_1$ and $R_2$ each represents a hydrogen atom or an organic group having 1 to 50 carbon atoms, and $n_1$ and $n_2$ each represents 1 to 1000), the content of which is 2 to 60% by weight based on the total amount of said finishing agent, said polyether containing an ethylene oxide unit and a propylene oxide unit, which are random-polymerized or block-copolymerized, (3) a non-ionic surfactant which is at least one selected from a compound prepared by adding ethylene oxide or propylene oxide to an alcohol having 1 to 30 carbon atoms and a compound prepared by adding ethylene oxide and/or propylene oxide to a carboxylic acid, amine or amide having 5 to 30 carbon atoms, the number of moles of the total amount of oxides to be added being 1 to 100, the content of which is 5 to 40% by weight based on the total amount of said finishing agent, and (4) an ionic surfactant, the content of which is 2 to 20% by weight based on the total amount of said finishing agent, the total amount of said compounds (1) to (4) being 80 to 100% by weight based on the total amount of said finishing agent.

The polyester fiber of the present invention is a polyester fiber having such abrasion properties that a fiber-fiber dynamic friction coefficient is from 0.3 to 0.45 and a fiber-metal dynamic friction coefficient is from 0.17 to 0.3, wherein spinning and processing properties are excellent and improved by using the above-described specific finishing agent.

The fiber-fiber dynamic friction coefficient is a parameter which shows the ease of causing a nap due to friction between the fibers. On the other hand, fiber-metal dynamic friction coefficient is a parameter which shows the ease of causing a nap due to rubbing between the fiber and the metal portion such as roll and hot plate.

When the fiber-fiber dynamic friction coefficient is smaller than 0.3, excess slip of the fiber occurs thereby to lower the spinning and drawing properties. On the other hand, when the fiber-fiber dynamic friction coefficient exceeds 0.45, the friction between the fibers becomes too large and a nap of the fiber is liable to occur. Furthermore, the fiber-metal dynamic friction coefficient is smaller than 0.17, excess slip of the fiber on the roll surface occurs thereby to lower the spinning and drawing properties. On the other hand, when the fiber-metal dynamic friction coefficient exceeds 0.3, the friction becomes too large and a nap is liable to occur.

The fiber-fiber static friction coefficient is a parameter which shows the quality of the wound form of a pirn or a cheese. When the fiber-fiber static friction coefficient is within a range from 0.27 to 0.4, there can be formed a pirn or cheese wherein the fiber has excellent shape and unwinding properties.

In the polyester fiber of the present invention, the above-described specific finishing agent is applied to the fiber having a birefringence of 0.025 or more. In the fiber having a birefringence of 0.025 or more, fiber surface molecules are securely oriented and, therefore, the fiber surface is securely coated with a finishing agent without excessively penetrating the finishing agent into the fibers, thereby making it possible to exhibit the performances of the finishing agent as much as possible.

In addition, the fiber having such a specified birefringence exhibits excellent elastic recovery because PTT molecules in the fiber are suitably oriented, and the resulting cloth also exhibits excellent elastic recovery. The polyester fiber other than PTT, for example, PET fiber does not exhibit excellent elastic recovery even if the birefringence is 0.025 or more. When the birefringence is 0.025 or less, molecules are liable to move easily because of poor orientation of the molecules. For this cause, fiber exhibits a low elastic recovery and becomes readily changed in properties under a slight change of temperature and load during storage or conveyance. In addition, since the applied finishing agent excessively penetrates into the fibers, properties of the finishing agent are deteriorated when the fibers are stored for a long period.

Since the PTT fiber is sufficiently oriented in a fiber having a birefringence of 0.05 or more, preferably from 0.05 to 0.1, its friction properties are not lowered during the weaving/knitting step, the false twisting step without drawing, and dyeing step.

Not only the polyester fiber having a birefringence of 0.025 to 0.05 is particularly suited for a fiber to be stretched and false-twist textured, but also the PTT molecules are suitably oriented, so that the properties of the fiber are not changed during the step of usual handling such as storage and transportation.

The polyester fiber of the present invention may be a multifilament or monofilament, or may be any of a short fiber and long fiber. The fineness of the polyester fiber of the present invention is not specifically limited, but is usually within a range from 5 to 200 d in terms of a total fineness and is usually within a range from 0.0001 to 10 d in terms of a single yarn fineness. The shape of the section includes, but is not limited to, a circular shape, a triangular shape, a flat shape and a star shape, and the fiber may also be a solid or hollow fiber.

BEST MODE FOR CARRYING OUT THE INVENTION

The polymer constituting the polyester fiber of the present invention is made of PTT obtained by polycondensing 90% by weight or more of terephthalic acid with 1,3-trimethylene glycol. Within the range where the object of the present invention is not impaired, that is, 10% by weight or less, one or more other copolymers or polymers may be copolymerized and blended. The comonomer and polymer include, for example, oxalic acid, succinic acid, adipic acid, isophthalic acid, phthalic acid, 2,6-naphthalenedicarboxylic acid, cyclohexanedicarboxylic acid, ethylene glycol, butanediol, cyclohexanedimethanol, 5-sodium sulfoisophthalic acid, tetrabutyl phosphonium 5-sulfoisophthalate, polyethylene glycol, polybutylene glycol, polyethylene terephthalate, and polybutylene terephthalate.

If necessary, various additives, for example, delustering agents, thermal stabilizers, defoamers, flame retardants, antioxidants, ultraviolet absorbers, infrared absorbers, crystal nucleating agents, and fluorescent whiteners may be copolymerized or mixed.

The birefringence of the polyester fiber of the present invention is 0.025 or more. When the birefringence is within the above range, the fiber exhibits an excellent elastic recovery because PTT molecules in the fiber are suitably oriented. The resulting cloth also exhibits an excellent elastic recovery. The polyester resin other than PTT, for example, PTT fiber cannot exhibit an excellent elastic recovery even if the birefringence is adjusted to 0.025 or more.

When the finishing agent in the present invention is applied to the PTT fiber having the birefringence of 0.025 or more, since the fiber surface molecules are securely oriented, the fiber surface is securely coated with the finishing agent without excessively penetrating into the fiber, thus making it possible to bring out the performances of the finishing agent as much as possible. When the birefringence is less than 0.025, the molecules move easily because of poor orientation of the molecules. Therefore, the finishing agent cannot be used for the purpose of the present invention because of low elastic recovery and change of properties of the yarn caused by a small change in temperature and application of load during the storage or transportation. Since the finishing agent applied excessively penetrates into the fiber, the properties of the finishing agent are impaired by storing for a long period. The fiber having the birefringence within a range from 0.025 to 0.05 is particularly suited for a fiber to be subjected to false-twin texturing with drawing. Since the PTT molecules are suitably oriented, the performances of the fiber having such a birefringence are not changed during a conventional handling process such as storage and transportation. However, the fiber exhibits excellent drawing, false-twist texturing and crimping properties in the drawing and false twisting steps. The fiber having the birefringence of 0.05 or more, preferably from 0.05 to 0.1, can be processed into a cloth through the weaving/knitting step, false twining step with no drawing, and dyeing step because the PTT fibers are sufficiently oriented.

The polyester fiber of the present invention comprises at least 90% by weight of PTT, and a birefringence of 0.025 or more and application of a finishing agent described below to the fiber make it possible to bring out performances of the PTT fiber such as excellent elastic recovery and soft hand as much as possible and to noticeably improve the processability from the spinning step to the false-twin texturing step. Thus, it becomes possible to bring out good qualities such as elastic recovery, softness and homogeneity for the woven/knitted fabric.

In the present invention, the finishing agent refers to an organic mixture to be applied to the surface of the fiber.

The finishing agent used in the present invention comprises, as essential components, compounds (1) to (4):

(1) an aliphatic hydrocarbon ester having a molecular weight of 300 to 800 and/or a mineral oil having a Redwood viscosity at 30° C. of 40 to 500 seconds, the content of which is 30 to 80% by weight based on the total amount of said finishing agent, (2) a polyether having a structure represented by the following structural formula:

$$R_1—O—(CH_2CH_2O)n_1—(CH(CH_3)CH_2O)n_2—R_2$$

(wherein $R_1$ and $R_2$ each represents a hydrogen atom or an organic group having 1 to 50 carbon atoms, and $n_1$ and $n_2$ each represents 1 to 1000), the content of which is 2 to 60% by weight based on the total amount of said finishing agent, said polyether containing an ethylene oxide unit and a propylene oxide unit, which are random-polymerized or block-copolymerized, (3) a non-ionic surfactant which is a compound prepared by adding ethylene oxide or propylene oxide to at least one selected from an alcohol, carboxylic acid, amine or amide having 1 to 30 carbon atoms, the number of moles of the total amount of oxides to be added being 1 to 100, the content of which is 5 to 40% by weight based on the total amount of said finishing agent, and (4) an ionic surfactant, the content of which is 2 to 20% by weight based on the total amount of said finishing agent, the total amount of said compounds (1) to (4) being 80 to 100% by weight based on the total amount of said finishing agent.

[1] Compound (1)

The compound (1) as a first essential constituent component of the finishing agent is composed of an aliphatic hydrocarbon ester having a molecular weight of 300 to 800 and/or a mineral oil having a Redwood viscosity at 30° C. of 40 to 500 seconds.

These aliphatic hydrocarbon ester and/or mineral oil are components required to improve the smoothness property of the PTT fiber thereby to reduce the friction coefficient. The aliphatic hydrocarbon ester includes, for example, various synthetic products and natural fats and oils. An aliphatic hydrocarbon ester as a synthetic product having a linear structure is particularly preferred to improve the smoothness property.

The aliphatic hydrocarbon ester as the synthetic product includes, for example, monoester, diester, triester, tetraester, pentaester and hexaester. In view of the smoothness property, monoester, diester and triester are preferably used. When the molecular weight of the aliphatic hydrocarbon ester is 300 or less, there arise problems that too low strength of the oil film causes easy removal of the ester from the surface of the fiber due to the guide and roll, resulting in lowering of the smoothness property of the fiber and that too low vapor pressure causes scattering of the ester in the step, resulting in a poor operation environment. When the molecular weight of the aliphatic hydrocarbon ester exceeds 800, the smoothness and sizing properties are lowered because of too high viscosity of the finishing agent, which is not preferred. The aliphatic hydrocarbon polyester having a molecular weight of 300 to 550 is a most preferred aliphatic hydrocarbon ester because of its particularly excellent smoothness property. Specific examples of the preferred synthetic product include isooctyl stearate, octyl stearate, octyl palmitate, isooctyl palmitate, 2-ethylhexyl stearate, oleyl laurate, isotridecyl stearte, oleyl oleate, dioleyl adipate and glycerin trilaurate. Of course, two or more aliphatic hydrocarbon esters may be used in combination. Octyl stearate, oleyl oleate, lauryl oleate and oleyl oleate are particularly preferred. Among these aliphatic hydrocarbon esters, an aliphatic hydrocarbon ester of a monohydric carboxylic acid and a monohydric alcohol is particularly preferred in view of molecular structure because it is superior in smoothness property. To enhance the heat resistance, an aliphatic hydrocarbon ester having a molecular weight of 400 to 800 is preferably used. In this case, a group wherein portion of hydrogen atoms may be substituted with a group containing a hetero atom such as oxygen atom and sulfur atom, for example, ether group, ester group, thioester group and sulfide group.

The mineral oil includes, for example, paraffinic, naphthenic and aromatic mineral oils. In view of an improvement in smoothness property, a paraffinic or a naphthenic mineral oil is preferably used. Of course, two or more mineral oils may be used in combination. As the mineral oil, for example, those having a Redwood viscosity at 30° C. of 40 to 500 seconds are preferably used. The mineral oil having the Redwood viscosity less than 40 seconds is liable to be scattered and the effect may be lowered. When the mineral oil exhibits a Redwood viscosity of 500 seconds or more, the effect of improving the smoothness property is lowered because of high viscosity. The Redwood viscosity of the mineral oil is preferably from 50 to 400 seconds.

It is important to enhance the smoothness property that the content of the aliphatic hydrocarbon ester and/or mineral oil in the finishing agent in the present invention is from 30 to 80% by weight. When the content is less than 30% by weight, the smoothness property is poor. On the other hand, when the content is 80% by weight, the wound form of the pirn or cheese prepared by winding the fiber becomes poor because of too high a smoothness property. When using for false twisting, the content is preferably from 30 to 60% by weight. When using for weaving and knitting, the content is preferably from 50 to 70% by weight because a high smoothness property is required.

[2] Compound (2)

A second essential constituent component of the finishing agent is a polyether shown in the compound (2). The compound (2) serves to enhance the strength of the oil film formed on the surface of the fiber by the finishing agent, and is a component required to remarkably improve poor abrasion resistance as a drawback of the PTT fiber as a result of the addition of the component. Particularly, it exhibits such a noticeable effect that a nap of the fibers hardly occurs when the fibers are rubbed with each other during the spinning, drawing, false-twin texturing and weaving and knitting steps.

$$R_1—O—(CH_2CH_2O)n_1—(CH(CH_3)CH_2O)n_2—R_2 \quad (2)$$

In the formula, $R_1$ and $R_2$ each represents a hydrogen atom or an organic group having 1 to 40 carbon atoms, and $n_1$ and $n_2$ each represents 1 to 1000. The organic group may be a hydrocarbon group, or portion or all of hydrocarbon groups may be substituted with a group or element containing a hetero atom, such as ester group, hydroxyl group, amide group, carboxyl group, halogen atom and sulfonic group. Preferably, hydrogen atom, $R_1$ and $R_2$ are aliphatic alcohol, aliphatic carboxylic acid, aliphatic amine and aliphatic amide residue, and the number of carbon atoms is preferably from 5 to 18. In the compound (2), an ethylene oxide unit and a propylene oxide unit may be random-polymerized or block-copolymerized. In case where a weight ratio of the propylene oxide unit to the ethylene oxide unit is from 20/80 to 70/30, the effect of inhibiting abrasion is high. More preferably, the weight ratio of the propylene oxide unit to the ethylene oxide unit is from 20/80 to 60/40. The molecular weight of the compound (2) is preferably from 400 to 20000, and particularly preferably from 1500 to 20000. In this case, a value corresponding to the molecular weight is employed as n, and $n_2$. The molecular weight is particularly important. When the molecular weight is less than 400, the effect of inhibiting abrasion is small. On the other hand, when the molecular weight exceeds 20000, the static friction coefficient of the fiber is too reduced and the wound form tends to be bad. More preferably, the molecular weight is from 1500 to 15000. It is necessary that the content of the compound (2) in the finishing agent is from 2 to 60% by weight. When the content is less than 2% by weight, the effect of improving the abrasion resistance is small. On the other hand, when the content exceeds 60% by weight, the wound form is bad because of too low a fiber-fiber friction coefficient. When using for false-twin texturing, the content is preferably from 3 to 60% by weight, and particularly preferably from 5 to 40% by weight. When using for weaving and knitting, the content is preferably from 5 to 30% by weight.

[3] Compound (3)

A third essential constituent component of the finishing agent is a nonionic surfactant which is at least one selected from a compound prepared by adding ethylene oxide or propylene oxide to an alcohol having 1 to 30 carbon atoms and a compound prepared by adding ethylene oxide and/or propylene oxide to a carboxylic acid, amine or amide having 1 to 30 carbon atoms, the number of moles of the total amount of oxides to be added being 1 to 100, the content of which is 5 to 40% by weight based on the total amount of said finishing agent.

The nonionic surfactant is a component required to impart emulsifying property for properly emulsifying the respective components of the finishing agent, cohesiveness of fibers, application property of the finishing agent and abrasion resistance. The nonionic surfactant may have a linear or branched molecular structure or contain a plurality of functional groups. A portion or all of the hydrogen atoms may be substituted with a group or element containing a hetero atom, such as ester group, hydroxyl group, amide group, carboxyl group, halogen atom and sulfonic group.

The number of carbon atoms of the alcohol, carboxylic acid, amine and amide is from 1 to 30, preferably from 5 to 30 in view of the emulsifying property and cohesiveness, and more preferably from 8 to 18. The number of moles of ethylene oxide and propylene oxide added is from 1 to 100, and preferably from 3 to 15 in view of high smoothness property. In case where the ethylene oxide and propylene oxide coexist, they may be random-copolymerized or block-copolymerized.

Specific examples of the nonionic surfactant include polyoxyethylene stearyl ether, polyoxyethylene stearyl oleyl ether, .polyoxyethylene oleyl ether, polyoxyethylene cetyl ether, polyoxyethylene lauryl ether, monobutyl ether prepared by copolymerization of propylene oxide and ethylene oxide, polyoxyethylene bisphenol A dilaurate, polyoxyethylene bisphenol A laurate, polyoxyethylene bisphenol A distearate, polyoxyethylene bisphenol A stearate, polyoxyethylene bisphenol A dioleate, polyoxyethylene bisphenol A oleate, polyoxyethylene stearylamine, polyoxyethylene laurylamine, polyoxyethylene oleylamine, amide polyoxyethyleneoleate, amide polyoxyethylenelaurate, amide polyoxyethylenestearate, ethanolamide polyoxyethylenelaurate, ethanolamide polyoxyethyleneoleate, diethanolamide polyoxyethyleneoleate, amide diethylenetriamineoleate, polyoxypropylene stearyl ether, polyoxypropylene bisphenol A stearate, polypropylene stearylamine and amide polypropyleneoleate.

It is required to enhance the emulsifying property, cohesiveness of fibers, application property of the finishing agent and abrasion resistance that the content of these nonionic surfactants in the finishing agent is from 5 to 40% by weight. When the content is less than 5% by weight, the above performances are poor. On the other hand, when the content exceeds 30% by weight, a nap is liable to occur because of too high a friction. The content is preferably from 5 to 30% by weight.

[4] Compound (4)

A fourth essential constituent component of the finishing agent is an ionic surfactant. The ionic surfactant is a component required to impart the anti-static electricity property, abrasion resistance, emulsifying property and anti-corrosive property to the fiber.

As the ionic surfactant, any of an anionic surfactant, a cationic surfactant and an amphoteric surfactant may be used. The anionic surfactant is preferably used because the anti-static electricity property, abrasion resistance, emulsifying property and anti-corrosive property can be imparted. Particularly, a sulfonate salt compound, a phosphate and a higher fatty acid salt are preferred. Of course, two or more anionic surfactants may be used in combination. Specific examples of preferred ionic surfactant include the compounds (5) to (8) and these compounds are particularly superior in anti-static electricity property, abrasion resistance, emulsifying property and anti-corrosive property.

$$R_5—SO_3—X, \quad (5)$$

$$(R_6—O—)P(=O)(OX)_2, \quad (6)$$

$$(R_7—O—)(R_8—O—)P(=O)(OX), \text{ and} \quad (7)$$

$$R_9—COO—X \quad (8)$$

In these formulas, $R_1$ to $R_9$ each represents a hydrogen atom or an organic group having 4 to 40 carbon atoms. The organic group may be a hydrocarbon group, or portion or all of hydrocarbon groups may be substituted with a group or element containing a hetero atom, such as ester group, hydroxyl group, amide group, carboxyl group, halogen atom and sulfonic group. Preferably, it is a hydrocarbon group having 8 to 18 carbon atoms. X is an alkali metal or an alkali earth metal.

It is necessary to enhance the anti-static electricity property that the content of the nonionic surfactant in the finishing agent is from 2 to 20% by weight. When the content is less than 2% by weight, the anti-static electricity property, abrasion resistance, emulsifying property and anti-corrosive property are poor and the wound form is bad because of too low a fiber-fiber dynamic friction coefficient and too low a fiber-fiber static friction coefficient. On the other hand, when the content exceeds 20% by weight, a nap is liable to occur because of too high a friction. When using for false-twin texturing, the content is preferably from 2 to 15% by weight. When using for weaving and knitting, the content is preferably from 5 to 15% by weight.

It is necessary for the finishing agent containing the four above-described essential constituent components that the content of these four essential constituent components is within a range from 80 to 100% by weight based on the total amount of the finishing agent. Components for finishing agent may be contained in the finishing agent used in the present invention in the amount within the range where the object of the present invention is not inhibited, that is, less than 20% by weight. The components for a finishing agent are not specifically limited, but a silicone compound, for example, dimethylsilicone, a compound prepared by adding about 3 to 100 moles of ethylene oxide and/or propylene oxide to portion of methyl groups of dimethylsilicone through an alkyl group, and amine oxide having an organic group having 5 to 18 carbon atoms may be contained to improve the smoothness property and spreadability of the finishing agent over the fiber. To improve the antistatic electricity property, an imidazoline compound having a carboxylic acid metal salt unit may also be contained, in addition to the compound other than those defined in the present invention. The ester compound defined in the present invention, for example, an ester having an ether group may also be contained. Known antiseptics, anti-corrosive agents and antioxidants may also be contained. The content is preferably 10% by weight or less, and more preferably 7% by weight or less.

The finishing agent comprising the above constituent components can be applied to the fiber as an emulsion finishing agent without diluting, or after 5 to 60% by weight, preferably 5 to 35% by weight of the finishing agent was dispersed in water.

It is necessary that the amount of the finishing agent to be applied onto the fiber is from 0.2 to 3% by weight. When the amount is less than 0.2% by weight, the effect of the finishing agent is lowered. On the other hand, when the amount exceeds 3% by weight, the resistance of the fiber on running becomes too large and the finishing agent is adhered on the hot plate and guide to thereby contaminate them. When used for false-twist texturing, the content is preferably from 0.3 to 1.0% by weight, and particularly preferably from 0.3 to 0.6% by weight. When used for weaving and knitting, the content is preferably from 0.4 to 1.2% by weight, and particularly preferably from 0.5 to 1% by weight. Of course, a portion of the finishing agent may penetrate into the interior of the fiber.

The finishing agent used in the present invention can be applied to the fiber at any time as long as the spun yarn has been solidified after melt spinning of the polyester fiber of the present invention. Usually, the finishing agent is preferably applied before taking up. The spinning method, to which the finishing agent is applied, may be a method of drawing using a drawing machine after taking up an undrawn yarn, a method of preparing a semi-drawn yarn at 2000 to 4000 m/min and a high-speed spinning method of spinning and drawing at a spinning speed of 5000 to 14000 m/min. The birefringence of the polyester fiber of the present invention can be adjusted to 0.025 or more by spinning and drawing so that the extension of the resulting fiber is from 25 to 180%, preferably from 25 to 150%, and more preferably from 35 to 130%.

The fiber thus obtained is a fiber which satisfies both of the fiber-fiber dynamic friction coefficient of 0.3 to 0.45 and the fiber-metal dynamic friction coefficient of 0.17 to 0.3 and has good spinning properties and processability. The fiber-fiber dynamic becomes too large and a nap of the fiber is liable to occur. The fiber-metal dynamic friction coefficient is preferably from 0.3 to 0.23.

Furthermore, when the fiber-fiber static friction coefficient is within a range from 0.27 to 0.4, a more preferred fiber is obtained. Since the fiber-fiber static friction coefficient corresponds to the amount of polyether, both good abrasion resistance and wound form can be attained by controlling the amount of polyether thereby to adjust the fiber-fiber static friction coefficient within arrange from 0.27 to 0.4. The fiber-fiber static friction coefficient is a parameter which shows the quality of the wound form of a pirn or a cheese. When the fiber-fiber static friction coefficient is less than 0.27, the wound form is not retained because of a too-small fiber-fiber static friction coefficient. On the other hand, when the fiber-fiber static friction coefficient exceeds 0.4, a fiber having a high friction coefficient is obtained and the processability is lowered. The fiber-fiber static friction coefficient is preferably within a range from 0.28 to 0.35.

The polyester fiber of the present invention exhibits the following physical properties of the fiber.

The tenacity of the polyester fiber is preferably 3 g/d or more in the case of a drawn yarn, while it is preferably 1.0 g/d in the case of a semi-drawn yarn. When the strength is less than 3 g/d in the case of the drawn yarn, the tear strength and burst strength of the resulting cloth are reduced depending on the use. The strength is preferably 4 g/d or more.

The elongation of the polyester fiber of the present invention is usually from 25 to 180%. When the elongation is less than 25%, the abrasion property of the fiber is drastically lowered and the abrasion property becomes poor even if the finishing agent described below is applied to the fiber, thereby making it difficult to apply it to practical use. On the other hand, when the elongation exceeds 180%, orientation of the fibers becomes poor and the fiber easily may cause the change of properties due to a slight change in temperature and application of weight. In order to preferably use as a drawn yarn, the elongation is preferably from 35 to 55% to inhibit the occurrence of nap, while the extension is preferably from 40 to 130% to use as a semi-drawn yarn to be stretched and false-twined.

The elastic recovery at 20% extension of the polyester fiber according to the present invention is preferably 70% or more. By satisfying the elastic recovery, the resulting cloth has a markedly excellent stretching property. The elastic recovery at 20% extension is preferably 80% or more.

The elastic modulus of the polyester fiber of the present invention is within a range from 10 to 30 g/d. Such a low elastic modulus leads to a cloth having markedly sot hand. The elastic modulus is preferably from 20 to 25 g/d.

The intrinsic viscosity [η] of the polyester fiber according to the present invention is preferably from 0.4 to 2.0, particularly preferably from 0.5 to 1.5, and more preferably from 0.6 to 1.2. When the intrinsic viscosity is within the above range, a fiber having excellent strength and spinning property can be obtained. When the intrinsic viscosity is less than 0.4, the melt viscosity of the polymer is too small so that spinning becomes unstable and the strength of the resulting fiber is low, which is not satisfactory. On the other hand, when the intrinsic viscosity exceeds 2.0, melt fracture and poor spinning occur on spinning because of too large a melt viscosity.

EXAMPLES

The following Examples further illustrate the present invention in detail but are not to be construed to limit the scope thereof. Principal measured values in the Examples were determined by the following procedures.

(1) Measurement of Intrinsic Viscosity

The intrinsic viscosity [η] was determined as follows. That is, a specific viscosity ηsp was measured by an Ostward viscometer using o-chlorophenol at 35° C. and a ratio of the specific viscosity ηsp to the concentration C (g/100 ml), ηsp/C, was extrapolated to the concentration of 0, and then the intrinsic viscosity was determined according to the following equation.

$$[\eta]=\lim_{C\to 0}(\eta sp/C)$$

(2) Measurement of Redwood Viscosity

It was measured according to JIS-K2283-1956.

(3) Measurement of Birefringence

It was determined by retardation observed on the surface of the fiber, using an optical microscope and a compensator, according to Handbook of Fibers, Raw Material Edition, p. 969 (the fifth impression, published by Maruzen Co., Ltd. on 1978).

(4) Measurement of Mechanical Properties (Tenacity, Elongation and Elastic Modulus) of Fiber It was measured according to JIS-L-1013.

(5) Measurement of Elastic Recovery

The fiber was attached to a tensile tester with a distance between chucks of 20 cm, stretched to an extension of 20% at a testing speed of 20 cm/min., and then allowed to stand for one minute. Thereafter, the fiber was allowed to contract at the same speed and a stress-strain curve was drawn.

During the contraction, the elongation at the stress of 0 is taken as a residual elongation (A).

$$\text{Elastic recovery}=(20-A)/20\times 100\ (\%)$$

(6) Proportion-of Oil Applied

Based on JIS-L-1013, the fiber was washed with ethyl ether and the ethyl ether was distilled off, and then the amount of a pure oil agent applied on the surface of the fiber was divided by the weight of the fiber to obtain a proportion, which was taken as an proportion of oil applied.

(7) Number of Yarns Brocken Due to Friction

The number of yarns broken due to friction is determined by counting the number of rubbings until fibers are rubbed with each other to cause to be brocken, and is a measure of ease of abrading of the side of the fiber. The larger the number, the better the abrasion resistance.

The number of yarns cut due to friction was measured by using a yarn friction embracing force testing machine (No. 890). Both ends of the yarn were connected through a pulley using two adjacent clasps. These clasps are capable of subjecting to a reciprocating motion at a stroke length of 20 mm. After the pulley was rotated to give two twists and a load of 50 g was applied, the clasps were subjected to a reciprocating motion at 150 strokes/min. The number of the strokes of the reciprocating motion was counted by a counter. The number of yarn brockage is given in terms of the number of strokes until the yarn is broken.

(8) Fiber-fiber static friction coefficient

The fiber of about 690 m was wound around a cylinder at a diagonal angle of 15° while applying a tension of about 10 g and, furthermore, the same fiber as described above of 30.5 cm in length was hung on the cylinder. At this time, this fiber is present on the cylinder and is placed in the direction in parallel with the winding direction of the cylinder. A weight, whose weight value represented by the number of grams is 0.04 times as the total denier of the fiber hung on the cylinder, was connected to one end of the fiber hung on the cylinder, while a strain gauge was connected to the other end. Then, the cylinder was rotated at a circumferential speed of 0.016 mm/sec and the tension was measured by using the strain gauge. The fiber-fiber static friction coefficient f was determined from the tension thus measured according to the following equation:

$$f=1/\pi\times \ln\ (T_2/T_1)$$

where $T_1$ denotes a load of a weight hung on the fiber, $T_2$ denotes an average tension in at least 25 measurements, ln denotes a natural logarithm, and π denotes the ratio of the circumference of a circle to its diameter.

(9) Fiber-fiber Dynamic Friction Coefficient

The value f obtained by the same manner as in the term (8), except that the circumferential speed was adjusted to 18 m/min, was taken as the fiber-fiber static friction coefficient.

(10) Fiber-metal Dynamic Friction Coefficient

Using a μ meter manufactured by EIKO SOKKI Co., Ltd., the coefficient was measured under the following conditions.

On rubbing of the fiber at a speed of 100 m/min with a chromium satin-finished (roughness: 3s) iron cylinder having a diameter of 25 mm) at an angle (90°) between the direction for entering the fiber into a friction material and the direction for leaving out from the friction material under an atmosphere of 25° C. and 65% RH while applying a tension of 0.4 g/d to the iron cylinder, the dynamic friction coefficient μ of the fiber was determined according to the following equation:

$$\mu=(360\times 2.3026)/2\pi\theta\times \log_{10}(T_2/T_1)$$

where $T_1$ denotes a tension at the side for entering into the friction material (tension corresponding to 0.4 g per denier), $T_2$ denotes a tension at the side for leaving from the friction material, θ denotes 90° and π denotes the ratio of the circumference of a circle to its diameter.

(11) Occurrence of Scum

It was observed whether or not scum occurs in the periphery of a reed when a plain weave fabric is obtained by weaving using fibers as a warp and a weft. Fibers were woven at a warp density of 38.1 yarns/cm and a weft density of 31.5 yarns/cm using a weaving machine 2A-103 manufactured by TSUDAKOMA KOGYO Co., Ltd.

○: Scum did not occur.

Δ: Scum occurred slightly.

x: Scum occurred remarkably.

(12) Occurrence of Nap

After the fiber (yarn) was passed through a needle and an angle between a guide eye for entering into the needle and a guide eye for leaving out from the needle was maintained at 60°, the fiber was taken up in the form of a cheese under a tension of 0.6 g/d at a take-up speed of 2 m/min and then the number of naps on the end surface of the cheese was counted.

○: Nap did not occur.

Δ: One to three naps occurred.

x: Three or more naps occurred.

(13) Occurrence of Static Electricity

It was examined whether or not static electricity occurred when a plain weave fabric was obtained by weaving using the fibers as a warp and a weft, and the fibers were made to contact with each other when passed through a reed.

Δ: observed x: not observed

(14) Evaluation of Shape of Wound Form

It was examined whether or not the wound form is retained when a 3 kg pirn was prepared.

Δ: not observed x: observed

Reference Example 1

Synthesis of Poly(trimethylene terephthalate) polymer

Dimethyl terephthalate (hereinafter abbreviated to "DMT") and trimethylene glycol (1,3-propanediol) were charged in a molar ratio of 1:2 and 0.09% by weight/DMT (this unit represents % by weight based on the amount of DMT) of calcium acetate and 0.01% by weight/DMT of cobalt acetate were added and, after the temperature was gradually raised, the ester interchange reaction was completed at 240° C. To the resulting ester interchanged product, 0.05% by weight/DMT of trimethyl phosphate as a thermal stabilizer and 0.5% by weight/DMT of a titanium oxide matting agent for synthetic fiber having an average particle diameter of 0.35 μm were added and the mixture was reacted at 270° C. for two hours. The intrinsic viscosity of the resulting polymer was 0.75. Then, the solid reaction of the polymer was conducted under a nitrogen atmosphere at 215° C. for five hours, thereby to increase the intrinsic viscosity to 0.92.

Examples 1 to 8

The polymer obtained in Reference Example 1 was dried under a nitrogen atmosphere at 160° C. for three hours using a circulating dryer until the water content was reduced to 30 ppm. The resulting dried polymer was charged in an extruder and then extruded trough 36 circular holes having a diameter of 0.23 mm at 265° C. The group of filaments thus spun were solidified with cooling by spraying a cool air at 20° C. under a relative humidity of 90% at a speed of 0.4 m/sec. Using an oil supply nozzle, each of finishing agents shown in Table 1 in the form of a 10% water-dispersed emulsion was applied to the group of solidified filaments to obtain a yarn, which was then taken up at a speed of 160.0 m/min. The resulting undrawn yarn was drawn at the extension of about 40% while passing through a hot roll at 55° C. and a hot plate at 140° C. to obtain a drawn yarn of 50 d/36 f. The resulting fibers were fibers comprising at least 99% by weight of PTT.

Any of fibers on which the finishing agent of the composition within the range defined in the present invention exhibited excellent spinning and drawing properties. The fibers obtained in any of Examples were fibers which have high elastic recovery, low elastic modulus and soft feeling.

Comparative Examples 1 to 6

The procedure of Example 1 was repeated, except that the finishing agent was changed as described in Table 1.

In Comparative Example 1, since an aromatic hydrocarbon ester was used in place of the aliphatic hydrocarbon ester, the fiber-fiber dynamic friction coefficient and fiber-metal dynamic friction coefficient became higher and scum and nap occurred. The number of yarns cut due to friction was reduced because no polyether was contained.

In Comparative Example 2, a finishing agent free from the aliphatic hydrocarbon ester, used in a false-twist textured yarn of PET, was used. In this case, since the fiber-metal dynamic friction coefficient becomes higher, naps occurred when passed through the hot plate or roll. In a nap test, naps also occurred. As a result, the number of yarns cut due to friction was reduced.

In Comparative Example 3, a finishing agent containing an aliphatic hydrocarbon ester having a lower molecular weight than that within the range of the present invention was used. In this case, since the oil layer strength of the finishing agent was reduced, the fiber-metal dynamic friction coefficient becomes higher and naps occurred when it passed through the hot plate or roll. In a nap test, naps also occurred.

In Comparative Example 4, the test was conducted using a finishing agent containing a polyether in a larger amount than that within the range of the present invention. In this case, since the fiber-fiber static friction coefficient is lowered and the wound form was not retained, a 3 kg pirn could not be obtained.

In Comparative Example 5, a finishing agent whose proportion of an oil applied is lowered by using the finishing agent of Example 1, which is not within the range of the present invention, was used. In this case, since the fiber-fiber dynamic friction coefficient and fiber-metal dynamic friction coefficient become higher, naps and static electricity occurred.

In Comparative Example 6, a finishing agent, wherein the amount of an ionic surfactant is not within the range of the present invention, was used. In this case, static electricity occurred. Since the fiber-metal dynamic friction coefficient is too low, slipping on the roll was recognized.

Comparative Example 7

The finishing agent of Comparative Example 2 was applied on the PET fiber. In this case, the spinning and drawing could be conducted satisfactorily, though the fiber-fiber dynamic friction coefficient is not within the range of the PTT fiber according to the present invention. This fact shows that the PTT fiber has a lower friction coefficient than that of the PTT fiber and has an excellent resistance to rubbing between the fibers. The resulting fiber exhibited a low elastic recovery, and rigid feeling because of its high elastic modulus.

Comparative Example 8

The undrawn yarn of Example 1 exhibited a birefringence of 0.024, a tenacity of 1.6 g/d and an elongation of 230%. After being allowed to stand at 20° C. for 20 days, the undrawn yarn became very brittle because the physical properties of the fiber were changed with a lapse of time. Such a phenomenon was not observed in the case of the fibers of Examples 1 to 8.

Example 9

Using the finishing agent of Example 7, only spinning was conducted at a spinning speed of 3500 m/min. The resulting undrawn yarn exhibited a birefringence of 0.062, a tenacity of 2.7 g/d, an elongation of 74%, a proportion of an oil applied of 0.41%, a fiber-fiber dynamic friction coefficient of 0.35, a fiber-metal dynamic friction coefficient of 0.20 and a fiber-fiber static friction coefficient of 0.29, and the spinning property was good. Unlike the undrawn yarn of Comparative Example 8, the physical properties of the fiber were not changed with a lapse of time after being allowed to stand at 20° C. for 20 days.

Using a false-twin texturing machine SW46SSD manufactured by BERMAG Co., the semi-drawn yarn was drawn with heating at 160° C. at a draw ratio of 1.25 at a texturing speed of 450 m/min to form a textured yarn of 3600 T/m. In this case, the processability was good. The resulting textured yarn exhibited a good expansion feeling, a stretch property and a soft hand.

Comparative Example 9

The same procedure as in Comparative Example 2 was repeated, except that only spinning was conducted at a spinning speed of 3500 m/min. The resulting undrawn yarn exhibited a birefringence of 0.066, a tenacity of 2.5 g/d, an elongation of 82%, a fiber-fiber dynamic friction coefficient of 0.39, a fiber-metal dynamic friction coefficient of 0.32 and a fiber-fiber static friction coefficient of 0.30. Naps occurred on spinning because of high fiber-metal dynamic friction coefficient.

In the same manner as in Example 9, a trial of false-twist texturing of the semi-drawn yarn was made. However, it was impossible to take-up the yarn for a long time because a large number of naps occurred.

Examples 10 to 12

The same procedure as in Example 1 was repeated, except that the kind of the finishing agent was changed and PTT having an intrinsic viscosity of 0.8 was used. The fibers thus obtained were fibers comprising at least 99% by weight of PTT.

Any of those fibers having physical properties of the fiber and composition of the finishing agent, which are defined within the range of the present invention, exhibited excellent spinning and drawing properties.

Reference Example 2

Using a false-twin texturing machine LS-2 manufactured by MITSUBISHI INDSUSTRIES CO., the drawn yarns obtained in Example 5 and Example 8 were subjected to false-twin texturing under the conditions of a spindle rotating speed of 275000 rpm, a false twisting number of 3650 T/m, an overfeed rate of 4.1% and a false twisting temperature of 165° C. In any case, the resulting fiber exhibited good stretching property and good softness, and also exhibited a good false-twin texturing property without causing yarn cutting.

On the other hand, yarn cutting occurred frequently in any of the fibers of Comparative Examples 1 to 6.

Reference Example 3

In the same manner as described in the "method of examining the occurrence of scum", plain weave fabrics were made by using various fibers of Examples 1, 5 and 10, and Comparative Example 7. When using the fibers of Examples 1, 5 and 10, the resulting plain weave fabrics exhibited good softness and stretching property of about 10% in the weft direction. They exhibited a hand that has never been obtained in a conventional synthetic woven fabric.

On the other hand, when using the fiber of Comparative Example 7, the resulting plain weave fabric exhibited a hard hand and no stretching property.

TABLE 1

Properties of PTT fiber on which various finishing agents are applied

| Constituent components | | | Constituent components of finishing agents of Examples (% by weight) | | | | | | | |
|---|---|---|---|---|---|---|---|---|---|---|
| | | | 1 | 2 | 3 | 4 | 5 | 6 | 7 | 6 |
| Finishing agent | Polymer | | PTT | PTT | PTT | PTT | PTT | PTT | PTT | PTT |
| | Aliphatic hydrocarbon ester | Tetracosyl erucate (molecular weight: 674) | | | | 20 | | | | |
| | | Oleyl oleate (molecular weight: 532) | | | | 15 | | | | |
| | | Lauryl oleate (molecular weight: 436) | 20 | | | | | 16 | | 22 |
| | | Octyl stearate (molecular weight: 368) | 40 | 58 | 40 | 30 | 50 | 32 | | 19 |
| | | Propyl myristate (molecular weight: 270) | | | | | | | | |
| | Mineral oil | Liquid paraffin having Redwood viscosity of 130 seconds | | | 25 | | | | | |
| | Polyether (having hydroxyl group at Terminal) | EO/PO = 65/35, molecular weight: 20000 | | | | 3 | 20 | | | |
| | | EO/PO = 75/25, molecular weight: 10000 | | 10 | | | | | 10 | 40 |
| | | EO/PO = 70/30, molecular weight: 5000 | | | | | | 15 | 10 | 9 |
| | | EO/PO = 75/25, molecular weight: 1600 | 7 | | 5 | | | 22 | 30 | |
| | Nonionic surfactant | Oleyl ether added with 10 moles of POE | 8 | 8 | 10 | 7 | 7 | 12 | 10 | |
| | | Hardened castor oil ether added with 10 moles of POE | 10 | 10 | 7 | 10 | 9 | | 5 | 7 |
| | | Diethylenetriaminemonoolooamide added with 10 moles of POE | 5 | 4 | 3 | 5 | 4 | | | |
| | Ionic surfactant | $C_{18}H_{37}SO_3Na$ | 3 | 3 | 3 | 3 | 3 | 3 | 3 | 1 |
| | | $C_8H_{17}OP(=O)(ONa)_2$ | 4 | 4 | 4 | | 4 | | | 1 |
| | | $(C_8H_{17}O)_2P(=O)(ONa)$ | | | | 4 | | | | 1 |
| | | $C_{17}H_{35}COONa$ | 3 | 3 | 3 | 3 | 3 | | | |
| | Aromatic hydrocarbon ester | Bisoctanate of bisoxyethyl bisphenol A | | | | | | | | |
| | Content of constituent components in finishing agent (% by weight) | $W_1$ | 60 | 58 | 65 | 65 | 50 | 48 | 32 | 41 |
| | | $W_2$ | 7 | 10 | 5 | 3 | 20 | 37 | 50 | 49 |
| | | $W_3$ | 23 | 22 | 20 | 22 | 20 | 12 | 15 | 7 |
| | | $W_4$ | 10 | 10 | 10 | 10 | 10 | 3 | 3 | 3 |
| | | $W_1 + W_2 + W_3 + W_4$ | 100 | 100 | 100 | 100 | 100 | 100 | 100 | 100 |
| Product fibers | Processing properties | Proportion of oil applied (% by weight) | 0.74 | 0.64 | 0.71 | 0.64 | 0.67 | 0.42 | 0.82 | 0.41 |
| | | Number of yarns broken due to friction | 356 | 840 | 301 | 125 | >1000 | >1000 | 798 | 918 |
| | | Fiber-fiber dynamic friction coefficient | 0.41 | 0.37 | 0.37 | 0.35 | 0.42 | 0.37 | 0.44 | 0.40 |
| | | Fiber-metal dynamic friction coefficient | 0.21 | 0.20 | 0.20 | 0.23 | 0.22 | 0.20 | 0.24 | 0.21 |
| | | Fiber-fiber static friction coefficient | 0.31 | 0.29 | 0.32 | 0.33 | 0.27 | 0.28 | 0.31 | 0.28 |
| | | Scum | ○ | ○ | ○ | ○ | — | ○ | ○ | ○ |
| | | Nap | ○ | ○ | ○ | ○ | ○ | ○ | ○ | ○ |
| | | Static electricity | ○ | ○ | ○ | ○ | ○ | ○ | ○ | ○ |
| | | Wound form | ○ | ○ | ○ | ○ | ○ | ○ | ○ | |
| | Physical properties of fibers | Birefringence | 0.07 | 0.07 | 0.07 | 0.07 | 0.07 | 0.07 | 0.07 | 0.07 |
| | | Tenacity (g/d) | 4.5 | 4.4 | 4.5 | 4.4 | 4.5 | 4.4 | 4.6 | 4.5 |
| | | Elongation (%) | 42 | 41 | 42 | 42 | 42 | 40 | 37 | 37 |
| | | Elastic modulus (g/d) | 23 | 23 | 23 | 23 | 23 | 23 | 25 | 23 |
| | | Elastic recovery (%) | 80 | 80 | 80 | 80 | 80 | 81 | 82 | 88 |

TABLE 1-continued

Properties of PTT fiber on which various finishing agents are applied

| Constituent components | | | Constituent components of finishing agents of Comparative Examples (% by weight) | | | | | | |
|---|---|---|---|---|---|---|---|---|---|
| | | | 1 | 2 | 3 | 4 | 5 | 6 | 7 |
| Finishing agents | Polymer | | PTT | PTT | PTT | PTT | PTT | PTT | PET |
| | Aliphatic hydrocarbon ester | Tetracosyl erucate (molecular weight: 674) | | | | | | | |
| | | Oleyl oleate (molecular weight: 532) | | | | | | | |
| | | Lauryl oleate (molecular weight: 436) | | | | | 20 | 20 | |
| | | Octyl stearate (molecular weight: 368) | | | | 30 | 40 | 49 | |
| | | Propyl myristate (molecular weight: 270) | | | 65 | | | | |
| | Mineral oil | Liquid paraffin having Redwood viscosity of 130 seconds | | | | | | | |
| | Polyether (having hydroxyl group at terminal) | EO/PO = 65/35, molecular weight: 20000 | | | | 25 | | | |
| | | EO/PO = 75/25, molecular weight: 10000 | | 10 | | 40 | | | 10 |
| | | EO/PO = 70/30, molecular weight: 5000 | | 60 | | | | | 60 |
| | | EO/PO = 75/25, molecular weight: 1600 | | | | | 7 | 7 | |
| | Nonionic surfactant | Oleyl ether added witn 10 moles of POE | 8 | 20 | 9 | | 8 | 8 | 20 |
| | | Hardened castor oil ether added with 10 moles of POE | 10 | 7 | 11 | 3 | 10 | 10 | 7 |
| | | Diethylenetriaminemonoolooamide added with 100 moles of POE | 5 | | 5 | | 5 | 5 | |
| | Ionic surfactant | $C_{18}H_{37}SO_3Na$ | 3 | 3 | 3 | 2 | 3 | 1 | 1 |
| | | $C_8H_{17}OP(=O)(ONa)_2$ | 4 | | 4 | | 4 | | 1 |
| | | $(C_8H_{17}O)_2P(=O)(ONa)$ | | | | | | | 1 |
| | | $C_{17}H_{35}COONa$ | 3 | | 3 | | 3 | | |
| | Aromatic hydrocarbon ester | Bisoctanate of bisoxyethyl bisphenol A | 67 | | | | | | |
| | Content of constituent components in finishing agent (% by weight) | $W_1$ | 0 | 0 | 0 | 30 | 60 | 69 | 0 |
| | | $W_2$ | 0 | 70 | 0 | 65 | 7 | 7 | 70 |
| | | $W_3$ | 23 | 27 | 25 | 3 | 23 | 23 | 27 |
| | | $W_4$ | 10 | 3 | 10 | 2 | 10 | 1 | 3 |
| | | $W_1 + W_2 + W_3 + W_4$ | 33 | 100 | 35 | 100 | 100 | 100 | 100 |
| Product fibers | Processing properties | Proportion of oil applied (% by weight) | 0.81 | 0.61 | 0.40 | 0.70 | 0.18 | 0.74 | 0.61 |
| | | Number of yarns broken due to friction | 21 | 73 | 41 | >1000 | 356 | 321 | >1000 |
| | | Fiber-fiber dynamic friction coefficient | 0.46 | 0.38 | 0.55 | 0.47 | 0.51 | 0.34 | 0.29 |
| | | Fiber-metal dynamic friction coefficient | 0.52 | 0.31 | 0.25 | 0.21 | 0.50 | 0.16 | 0.20 |
| | | Fiber-fiber static friction coefficient | 0.38 | 0.31 | 0.32 | 0.26 | 0.33 | 0.26 | 0.28 |
| | | Scum | Δ | ○ | ○ | ○ | — | ○ | ○ |
| | | Nap | Δ | x | Δ | ○ | x | ○ | ○ |
| | | Static electricity | ○ | ○ | ○ | ○ | x | x | ○ |
| | | Wound form | ○ | ○ | ○ | x | ○ | x | ○ |
| | Physical properties of fibers | Birefringence | 0.07 | 0.07 | 0.07 | 0.07 | 0.07 | 0.07 | — |
| | | Tenacity (g/d) | 4.4 | 4.5 | 4.4 | 4.4 | 4.6 | 4.4 | 5.2 |
| | | Elongation (%) | 42 | 42 | 41 | 40 | 37 | 42 | 24 |
| | | Elastic modulus (g/d) | 23 | 23 | 24 | 23 | 25 | 23 | 105 |
| | | Elastic recovery (%) | 80 | 80 | 82 | 81 | 82 | 80 | 24 |

In the table, $W_1$, $W_2$, $W_3$ and $W_4$ represent the content (% by weight) of the compounds (1), (2), (3) and (4) in the finishing agent.
EO denotes ethylene oxide, PO denotes propylene oxide, and POE denotes polyoxyethylene, respectively.
"EO/PO = 65/35 and molecular weight of 20000" means that a weight ratio of an EO unit to a PO unit is 65/35 and the molecular weight of polyether is 20000. Any polyether is a block copolymer.
"added with 10 moles of POE" means that 10 moles of ethylene oxide was added.

TABLE 2

Properties of PTT fiber-on which various finishing agents are applied

| Constituent components | | | Constituent components of finishing agents of Examples (% by weight) | | |
|---|---|---|---|---|---|
| | | | 10 | 11 | 12 |
| Finishing agents | Polymer | | PTT | PTT | PTT |
| | Aliphatic hydrocarbon ester | Isooctyl stearate (molecular weight: 368) | 45 | | 72 |
| | Mineral oil | Liquid paraffin having Redwood viscosity of 130 seconds | 25 | 70 | |

TABLE 2-continued

Properties of PTT fiber-on which various finishing agents are applied

| | | | Constituent components of finishing agents of Examples (% by weight) | | |
|---|---|---|---|---|---|
| | Constituent components | | 10 | 11 | 12 |
| | Polyether (having hydroxyl group at terminal) | Polyether (having hydroxyl group at terminal) EO/PO = 60/40, molecular weight: 5000 | 7 | 7 | 15 |
| | Nonionic surfactant | Oleyl ether added with 10 moles of POE | 13 | 13 | 10 |
| | Ionic surfactant | Sodium alkanesulfonates each having 15 and 16 carbon atoms | 10 | 10 | 3 |
| | Content of constituent components in finishing agent (% by weight) | $W_1$ | 70 | 70 | 72 |
| | | $W_2$ | 7 | 7 | 15 |
| | | $W_3$ | 13 | 13 | 10 |
| | | $W_4$ | 10 | 10 | 3 |
| | | $W_1 + W_2 + W_3 + W_4$ | 100 | 100 | 100 |
| Product fibers | Processing properties | Proportion of oil applied (% by weight) | 0.7 | 0.7 | 0.5 |
| | | Numbers yarns cut due to friction | 412 | 312 | 456 |
| | | Fiber-fiber dynamic friction coefficient | 0.35 | 0.35 | 0.35 |
| | | Fiber-metal dynamic friction coefficient | 0.27 | 0.28 | 0.25 |
| | | Fiber-fiber static friction coefficient | 0.33 | 0.33 | 0.33 |
| | | Scum | ○ | ○ | ○ |
| | | Nap | ○ | ○ | ○ |
| | | Static electricity | ○ | ○ | ○ |
| | | Wound form | ○ | ○ | ○ |
| | Physical properties of fibers | Birefringence | 0.08 | 0.08 | 0.07 |
| | | Tenacity (g/d) | 4.0 | 4.1 | 4.4 |
| | | Elongation (%) | 27 | 35 | 40 |
| | | Elastic modulus (g/d) | 21 | 23 | 24 |
| | | Elastic recovery (%) | 88 | 84 | 82 |

In the table, $W_1$, $W_2$, $W_3$ and $W_4$ represent the content (% by weight) of the compounds (1), (2), (3) and (4) in the finishing agent.
Polyether is a random Copolymer.

Industrial Applicability

The polyester resin of the present invention has been attained by solving problems such as high friction coefficient and ease of abrading of the side of the fiber, and the polyester resin has smoothness property, abrasion resistance, cohesiveness and anti-static electricity property, and also has good processability during various steps from the spinning step to the post-processing step, for example, the spinning and drawing steps, unwinding step from yarn package, false-twist texturing, weaving, and knitting processings, and extremely good wound form of a yarn package. Thus, it is made possible to form a PTT fiber, on which a finishing agent specified by the present invention is applied, into a knitted/woven fabric having good quality such as elastic recovery, soft hand and homogeneity.

The polyester fiber of the present invention is not only suited for use as fiber materials for clothing such as raw yarn for outer wear, inner wear, sportswear, lining, panty stocking, tights, socks and artificial leather, and is but also useful in uses such as carpet, flocks, artificial leather, gut and artificial lawn.

What is claimed is:

1. A polyester fiber having a birefringence of 0.025 or more, comprising at least 90% by weight of a poly (trimethylene terephthalate), a finishing agent being applied on the surface of said fiber in the amount of 0.2% to 3% by weight, said finishing agent comprising, as an essential component, compounds (1) to (4):

(1) an aliphatic hydrocarbon ester having a molecular weight of 300 to 800 and/or a mineral oil having a Redwood viscosity of 30° C. of 40 to 500 seconds, the content of which is 41% to 80% by weight based on the total amount of said finishing agent, (2) a polyether having a structure represented by the following structural formula:

$$R_1—O—(CH_2CH_2O)n_1—(CH(CH_3)CH_2O)n_2—R_2$$

(wherein $R_1$ and $R_2$ each represents a hydrogen atom or an organic group having 1 to 50 carbon atoms, and $n_1$ and $n_2$ each represents 1 to 1000), the content of which is 5% to 30% by weight based on the total amount of said finishing agent, said polyether containing an ethylene oxide unit and a propylene oxide unit, which are random-polymerized or block-copolymerized, (3) a non-ionic surfactant which is at least one selected from a compound prepared by adding ethylene oxide or propylene oxide to an alcohol having 1 to 30 carbon atoms and a compound prepared by adding ethylene oxide and/or propylene oxide to a carboxylic acid, amine and amide having 1 to 30 carbon atoms, the number of moles of the total amount of oxides to be added being 1 to 100, the content of which is 5% to 30% by weight based on the total amount of said finishing agent, and (4) an ionic surfactant, the content of which is 2% to 15% by weight based on the total amount of said finishing agent, the total amount of said compounds (1) to (4) being 80% to 100% by weight based on the total amount of said finishing agent.

2. The polyester fiber according to claim 1, wherein a molecular weight of the aliphatic hydrocarbon ester is 300 to 550.

3. The polyester fiber according to claim 1 or 2, wherein a weight ratio of the propylene oxide unit to the ethylene oxide unit is 20:80 to 70:30 in the compound (2).

4. The polyester fiber according to claim 3, wherein the ionic surfactant is at least one compound selected from the following compounds (5) to (8):

$$R_5—SO_3—X, \quad (5)$$

$$(R_6—O—)P(=O)(OX)_2, \quad (6)$$

$$(R_7—O—)(R_8—O—)P(=O)(OX), \text{ and} \quad (7)$$

$$R_9—COO—X \quad (8)$$

(wherein $R_5$ to $R_9$ each represents a hydrogen atom or an organic group having 4 to 40 carbon atoms, and X represents an alkali metal or an alkali earth metal).

5. The polyester fiber according to claim 1 or 2, wherein a weight ratio of the propylene oxide unit to the ethylene oxide unit is 20:80 to 70,30 and the molecular weight is 1500 to 20000 in the compound (2).

6. The polyester fiber according to claim 5, wherein the ionic surfactant is at least one compound selected from the following compounds (5) to (8):

$$R_5—SO_3—X, \quad (5)$$

$$(R_6—O—)P(=O)(OX)_2, \quad (6)$$

$$(R_7—O—)(R_8—O—)P(=O)(OX), \text{ and} \quad (7)$$

$$R_9—COO—X \quad (8)$$

(wherein $R_5$ to $R_9$ each represents a hydrogen atom or an organic group having 4 to 40 carbon atoms, and X represents an alkali metal or an alkali earth metal).

7. The polyester fiber according to claim 1 or 2, wherein the ionic surfactant is at least one compound selected from the following compounds (5) to (8):

$$R_5—SO_3—X, \quad (5)$$

$$(R_6—O—)P(=O)(OX)_2, \quad (6)$$

$$(R_7—O—)(R_8—O—)P(=O)(OX), \text{ and} \quad (7)$$

$$R_9—COO—X \quad (8)$$

(wherein $R_5$ to $R_9$ each represents a hydrogen atom or an organic group having 4 to 40 carbon atoms, and X represents an alkali metal or an alkali earth metal).

8. A polyester fiber having a birefringence of 0.025 or more, comprising at least 90% by weight of a poly (trimethylene terephthalate), a finishing agent being applied on the surface of said fiber in the amount of 0.3% to 1.0% by weight, said finishing agent comprising, as an essential component, compounds (1) to (4):

(1) an aliphatic hydrocarbon ester having a molecular weight of 300 to 800 and/or a mineral oil having a Redwood viscosity at 30° C. of 40 to 500 seconds, the content of which is 41% to 60% by weight based on the total amount of said finishing agent, (2) a polyether having a structure represented by the following structural formula:

$$R_1—O—(CH_2CH_2O)n_1—(CH(CH_3)CH_2O)n_2—R_2$$

(wherein $R_1$ and $R_2$ each represents a hydrogen atom or an organic group having 1 to 50 carbon atoms, and $n_1$ and $n_2$ each represents 1 to 1000), the content of which is 5% to 30% by weight based on the total amount of said finishing agent, said polyether containing an ethylene oxide unit and a propylene oxide unit, which are random-polymerized or block-copolymerized, (3) a, non-ionic surfactant which is a compound prepared by adding ethylene oxide or propylene oxide to at least one selected from an alcohol, carboxylic acid, amine or amide having 1 to 30 carbon atoms, the number of moles of the total amount of oxides to be added being 1 to 100, the content of which is 5 to 30% by weight based on the total amount of said finishing agent, and (4) an ionic surfactant, the content of which is 2 to 15% by weight based on the total amount of said finishing agent, the total amount of said compounds (1) to (4) being 80% to 100% by weight based on the total amount of said finishing agent.

9. A polyester fiber having a birefringence of 0.025 or more, comprising at least 90% by weight of a poly (trimethylene terephthalate), a finishing agent being applied on the surface of said fiber in the amount of 0.4% to 1.2% by weight, said finishing agent comprising, as an essential component, compounds (1) to (4):

(1) an aliphatic hydrocarbon ester having a molecular weight of 300 to 800 and/or a mineral oil having a Redwood viscosity at 30° C. of 40 to 500 seconds, the content of which is 50% to 70% by weight based on the total amount of said finishing agent, (2) a polyether having a structure represented by the following structural formula:

$$R_1—O—(CH_2CH_2O)n_1—(CH(CH_3)CH_2O)n_2—R_2$$

(wherein $R_1$ and $R_2$ each represents a hydrogen atom or an organic group having 1 to 50 carbon atoms, and $n_1$ and $n_2$ each represents 1 to 1000), the content of which is 5% to 30% by weight based on the total amount of said finishing agent, said polyether containing an ethylene oxide unit and a propylene oxide unit, which are random-polymerized or block-copolymerized, (3) a non-ionic surfactant which is a compound prepared by adding ethylene oxide or propylene oxide to at least one selected from an alcohol, carboxylic acid, amine or amide having 1 to 30 carbon atoms, the number of moles of the total amount of oxides to be added being 1 to 100, the content of which is 5% to 30% by weight based on the total amount of said finishing agent, and (4) an ionic surfactant, the content of which is 5% to 15% by weight based on the total amount of said finishing agent, the total amount of said compounds (1) to (4) being 80% to 100% by weight based on the total amount of said finishing agent.

10. A polyester fiber having a birefringence of 0.025 or more, comprising at least 90% by weight of a poly (trimethylene terephthalate), characterized in that a fiber-fiber dynamic friction coefficient is from 0.3 to 0.45 and a fiber-metal dynamic friction coefficient is from 0.17 to 0.3.

11. A polyester fiber having a birefringence of 0.025 or more, comprising at least 90% by weight of a poly (trimethylene terephthalate), characterized in that a fiber-fiber dynamic friction coefficient is from 0.3 to 0.45 and a fiber-metal dynamic friction coefficient is from 0.17 to 0.3, and that a fiber-fiber static friction coefficient is from 0.27 to 0.4.

* * * * *